United States Patent [19]

Toyoshima et al.

[11] 4,404,000

[45] Sep. 13, 1983

[54] MIDDLE AND/OR HEAVY DISTILLATE COMPOSITION HAVING GOOD FLOW PROPERTY AND FILTERABILITY

[75] Inventors: Yoshiki Toyoshima; Sumio Hara, both of Niihama; Masaki Nakazyo, Saijo, all of Japan

[73] Assignee: Sumitomo Chemical Company, Limited, Osaka, Japan

[21] Appl. No.: 411,807

[22] Filed: Aug. 26, 1982

[51] Int. Cl.[3] ..... C10L 1/18

[52] U.S. Cl. ..... 44/62; 44/70; 526/329

[58] Field of Search ..... 44/70, 62; 525/223; 526/329

[56] References Cited

U.S. PATENT DOCUMENTS

| | | | |
|---|---|---|---|
| 3,048,479 | 8/1962 | Hayckyj et al. . | |
| 3,773,478 | 11/1973 | Feldman | 44/62 |
| 3,792,983 | 2/1974 | Tunkel et al. | 44/62 |
| 3,961,916 | 6/1976 | Hayckyj et al. . | |
| 4,087,255 | 5/1978 | Wisotsky . | |
| 4,108,612 | 8/1978 | Rossi et al. | 44/62 |
| 4,108,613 | 8/1978 | Frost, Jr. | 44/62 |
| 4,153,424 | 5/1979 | Wisotsky | 44/62 |

*Primary Examiner*—Charles F. Warren
*Assistant Examiner*—Y. Harris-Smith
*Attorney, Agent, or Firm*—Stevens, Davis, Miller & Mosher

[57] ABSTRACT

A middle and/or heavy distillate composition having a good flow property and filterability, comprising a fuel oil of varying proportions of middle and/or heavy distillate of petroleum and 10–2000 ppm, based on the fuel oil, of a mixture of 1–99% by weight of (A) a copolymer of ethylene with an alkoxyalkyl acrylate or methacrylate represented by the formula,

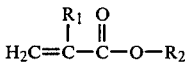

wherein $R_1$ represents hydrogen or $C_1$–$C_2$ alkyl and $R_2$ is $C_mH_{2m}$—O—$C_nH_{2n+1}$, m and n each being an integer of 1–4, and 99–1% by weight of (B) a copolymer of ethylene with a vinyl ester of saturated carboxylic acid and/or an alkyl ester of ethylenic unsaturated carboxylic acid.

2 Claims, No Drawings

MIDDLE AND/OR HEAVY DISTILLATE COMPOSITION HAVING GOOD FLOW PROPERTY AND FILTERABILITY

This invention relates to middle or heavy distillate compositions of petroleum having a good flow property and filterability.

It is well known that, among distillates of crude oil, in particular middle or heavy fractions of boiling points approximately 150°–450° C., called kerosene, light oil, or heavy oil, occupy a very important position as an energy source for the nation.

Light and heavy oils thereof can cause serious troubles under low temperature conditions in winter or in other cold circumstances, on account of a marked decrease in fluidity due to deposition of wax fractions contained in these oils. There are a great number of cases such that a strainer set up in a light oil feed line for a diesel engine is blinded by deposition of wax fractions in the light oil under a cold condition in winter and thereby the supply of the oil is stopped or further at a lower temperature the operation of diesel engine becomes impossible on account of a complete loss of fluidity of the oil. There are a number of instances of trouble, also on heavy oil, due to similar depositions of wax, such as engine stops in fishing boats and combustion troubles in boilers for greenhouse purposes. These troubles sometimes will give serious damages to life and property.

For this reason, various measures are taken to improve the low-temperature fluidity of these kinds of oils. For example, there is a method for improving the fluidity of light or heavy oil by diluting it with a kerosene fraction having a relatively good fluidity at low temperatures.

However, lighter distillates of oil such as kerosene are more expensive than light or heavy oil, so that this method cannot be said to be economical. It also cannot be regarded as a desirable method, from the viewpoint of effective utilization of oil source under the present conditions that there is a worldwide trend of increasing proportion of heavier crude oil supply while demands for lighter fractions of oil are increasing.

Another method for this purpose is to add a fluidity improver, for which chemical synthetic products are used in almost all the cases. The role of these fluidity improvers is to stabilize the wax deposit in microcrystalline form, thereby preventing its crystal growth. Various fluidity improvers have been proposed and actually are added to fuel oils, exhibiting a great effect. The following compounds are well known as typical fluidity improvers for fuel oils: Copolymers of ethylene with alkyl esters of unsaturated carboxylic acids or vinyl esters of saturated carboxylic acids, polyacrylates, alkylnaphthalenes, and alkenyl succinates and derivative of the succinates.

In particular, there are a number of proposals concerning utilization of the copolymers of ethylene with vinyl esters of saturated carboxylic acids as the fluidity improver, which are described, for example, in Japanese Patent Publication Nos. 20069 (1964), 23165 (1973) and 7605 (1975), and Japanese Patent Application Kokai (Laid-open) No. 48290 (1980). Of these copolymers, use of ethylene-vinyl acetate copolymer is rapidly increasing in recent years since it is effective for depressing not only pour points of fuel oils but also plugging points (highest temperature causing the above-mentioned blinding) thereof for low-temperature strainers. However, this copolymer is not always satisfactory in that its effect is limited to specific fuel oils and it needs to be added in a large amount in spite of its high relative cost.

As a result of investigations of various kinds of ethylene copolymers for the purpose of improving low-temperature fluidity and filterability of fuel oils, the present inventors have accomplished this invention through finding out the following facts: Combined use of a plurality of ethylene copolymers has a synergistic effect, not expectable from single use of these copolymers, of improving low-temperature fluidity of fuel oils and especially low-temperature filterability thereof; in addition, the effect of the combined use ranges a wide variety of fuel oils that cannot be covered with the prior art single copolymer.

Thus, this invention provides a middle and/or heavy distillate composition having a good flow property and filterability, comprising a fuel oil of varying proportions of middle and/or heavy distillate of petroleum and 10–2000 ppm, based on the fuel oil, of a mixture of 1–99% by weight of (A) a copolymer of ethylene with an alkoxyalkyl acrylate or methacrylate represented by the formula,

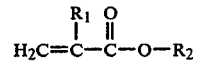

wherein $R_1$ represents hydrogen or $C_1$–$C_2$ alkyl and $R_2$ is $-C_mH_{2m}-O-C_nH_{2n+1}$, m and n each being an integer of 1–4, and 99–1% by weight of (B) a copolymer of ethylene with a vinyl ester of saturated carboxylic acid and/or an alkyl ester of ethylenic unsaturated carboxylic acid (hereinafter, the former copolymer is referred to briefly as ethylene copolymer (A) and the latter copolymer as ethylene copolymer (B).

As already stated, there have hitherto been known methods for improving the low-temperature fluidity of fuel oils by adding the ethylene copolymer (B) thereto. However, these ethylenic copolymers (B), when used separately, have an insufficient effect of improving the low-temperature fluidity and the effect is limited to some kinds of fuel oils.

According to this invention, such a synergistic effect of improving the low-temperature fluidity and filterability that cannot be expected from separate uses of ethylene copolymers (A) and (B) can be obtained by using mixtures thereof. Moreover, the effect according to this invention ranges over a wider variety of oils as compared with the effect of the separate uses and is especially remarkable in improving the low-temperature filterability.

This invention will hereinafter be explained in detail.

The middle and/or heavy distillate of petroleum in this invention, means fractions of b.p. approximately 130°–450° C. obtained by atmospheric or vacuum distillation of crude oil, which generally include light oil and so-called A-heavy oil (corresponding to first class heavy oil according to JIS).

The ethylene copolymers (A) and (B) used in this invention can be prepared by known processes, for example, free radical types of bulk polymerization, emulsion polymerization, and solution polymerization. In particular, the free radical type of bulk polymerization is industrially advantageous, which does not need solvent or some other materials. According to this process, ethylene and a comonomer shown below can be polymerized by using a continuous type of high pressure polymerization apparatus at a pressure of 500–4000 kg/cm$^2$ and a temperature of 100°–300° C. in the presence of a free radical initiator and a polymerization regulator, for example, as the initiator, an azo group catalyst such as $\alpha,\alpha'$-azobisisobutyronitrile or a peroxide type catalyst such as di-t-butyl peroxide, hydrogen peroxide, diethyl peroxide, persuccinic acid, alkali metal persulfate, alkaline earth metal persulfate, or ammonium persulfate, and as the polymerization regulator, propane, butane, propylene, butene, propionaldehyde, methyl ethyl ketone, tetrahydrofuran, n-butyraldehyde, acetone, or cyclohexanone.

The number average molecular weight and copolymer composition of the ethylene copolymer can be readily controlled to desired values by proper selection of polymerization conditions, for instance, reaction pressure, temperature, catalyst concentration, concentration of chain transfer agent (polymerization regulator), comonomer concentration, etc.

The alkoxyalkyl acrylates or methacrylates represented by the formula,

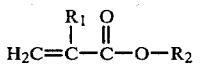

($R_1$ and $R_2$ are as defined above) include ethoxymethyl acrylate, 2-methoxyethyl acrylate, 2-ethoxyethyl acrylate, 2-ethoxypropyl acrylate, 2-methoxyethyl methacrylate, 2-ethoxyethyl methacrylate, 2-propoxyethyl methacrylate, and 2-butoxyethyl methacrylate, of which 2-methoxyethyl acrylate and 2-ethoxyethyl methacrylate are preferable.

The ethylene copolymer (A) has a number average molecular weight of desirably 700–5000, preferably 1000 to 4000 and an acrylate or methacrylate monomer unit content of desirably 5–40%, preferably 10–30%, by weight.

The comonomers to be copolymerized with ethylene into the ethylene copolymers (B) are alkyl esters of ethylenic unsaturated carboxylic acids or vinyl esters of saturated carboxylic acids including fatty acid esters such as vinyl acetate, vinyl propionate, vinyl butyrate, vinyl octanoate and vinyl stearate and acrylates or methacrylates such as methyl acrylate, methyl methacrylate, ethyl acrylate, ethyl methacrylate, butyl acrylate, butyl methacrylate, octyl acrylate, octyl methacrylate, dodecyl acrylate, dodecyl methacrylate, stearyl acrylate, and stearyl methacrylate, of which vinyl acetate is most suited.

The ethylene copolymer (B) has a number average molecular weight of desirably 700–5000, preferably 1000–4000, and a comonomer unit content of desirably 5–50%, preferably 10–40%, by weight.

The mixtures of ethylene copolymers (A) and (B) consist of 1–99%, preferably 10–90% by weight of the ethylene copolymer (A) and 99–1%, preferably 90–10%, by weight of the ethylene copolymer (B). If proportion of the ethylene copolymer (A) or (B) is less than 1% by weight or more than 99% by weight, the synergistic effect of the combined use is as little as within the range of error and it becomes therefore meaningless to have trouble to mix the two copolymers.

Suitable amounts of the mixture added to the fuel oil are 10–2000 ppm, preferably 30–1000 ppm, based on the oil, by weight. With the amount less than 10 ppm, almost no effect of the addition can be expected. The amount exceeding 2000 ppm results in worse economy relative to the effect obtained.

There is no particular restriction on the mode of adding the mixture of the ethylene copolymers (A) and (B) to the fuel oil. The two copolymers may be added either after being mixed or separately without the previous mixing. They may be added also in the form of concentrated solution in a suitable solvent selected from aliphatic hydrocarbons, aromatic hydrocarbons, etc.

Along with the ethylene copolymers, may be used some usual additives for petroleum distillate fuel oils, such as rust inhibitors, antioxidants, antistatic agents, and anticorrosives, and if necessary, a pour point depressant of other types.

This invention will be illustrated more specifically with reference to the following Examples and Comparative Examples; however, this invention is not limited to these Examples.

Examples 1–7 and Comparative Examples 1–11

Preparation of ethylene copolymers

Using a continuous high-pressue reaction vessel, different ethylene copolymers were prepared by copolymerizing ethylene and each comonomer at each temperature and pressure, shown in Table 1, in the presence of t-butyl peroxybenzoate as a polymerization initiator and propane as a chain transfer agent.

Comonomer contents and number average molecular weights of the ethylene copolymers obtained are shown in Table 2.

TABLE 1

| Experiment No. | Comonomer | Pressure (kg/cm$^2$) | Temperature (°C.) |
|---|---|---|---|
| 1 | 2-Ethoxyethyl methacrylate | 1050 | 210 |
| 2 | 2-Ethoxyethyl methacrylate | " | " |
| 3 | 2-Ethoxybutyl methacrylate | " | " |
| 4 | Vinyl acetate | 700 | 220 |
| 5 | " | 1400 | 240 |

TABLE 2

| Experiment No. | Copolymer | Comonomer content (% by weight) | Number average mol. wt. |
|---|---|---|---|
| 1 | A-1 | 26 | 2230 |
| 2 | A-2 | 35 | 1750 |
| 3 | A-3 | 28 | 2050 |
| 4 | B-1 | 19 | 1670 |
| 5 | B-2 | 38 | 2210 |

Preparation of fuel oil compositions and evaluation thereof:

Fuel oil compositions shown in Table 4 were prepared by adding different ethylene copolymers singly or in mixture to the fuel oil (1) or (2) shown in Table 3, and the fluidity and filterability thereof were evaluated.

The evaluation of fluidity and filterability was made by measuring the pour point and the cold filter plugging point according to the following methods: Results of the measurements are shown in Table 4.

Pour point: In accordance with JIS K-2269.

Cold filter plugging point: Measured according to the method reported in "Cold Filter Plugging Point of Distillate Fuels", IP-309, 1976, England, by using a 44-micron stainless steel screen.

TABLE 3

| Item | Fuel oil (1) | Fuel oil (2) |
|---|---|---|
| Specific gravity (15/4° C.) | 0.8461 | 0.8353 |
| Distillation character: | | |
| Initial B.P. (°C.) | 191 | 195 |
| 10% Distillation point (") | 232 | 226 |
| 50% Distillation point (") | 282 | 284 |
| 90% Distillation point (") | 358 | 335 |
| End B.P. (") | 372 | 358 |
| Pour point (°C.) | −2.5 | −5.0 |
| Cold filter plugging point (°C.) | 0 | −2 |

TABLE 4

| Example No. | Copolymer No. (mixing ratio) | Amount added (ppm) | Fuel oil | Pour point (°C.) | Cold filter plugging point (°C.) |
|---|---|---|---|---|---|
| Comparative Example 1 | A-1 (single copolymer) | 150 | (1) | −5.0 | −6 |
| Comparative Example 2 | A-2 (single copolymer) | " | " | −10.0 | −3 |
| Comparative Example 3 | A-3 (single copolymer) | " | " | −5.0 | −6 |
| Comparative Example 4 | B-1 (single copolymer) | " | " | −10.0 | −6 |
| Comparative Example 5 | B-2 (single copolymer) | " | " | −15.0 | −2 |
| Comparative Example 6 | A-1/A-2 (50/50) | " | " | −7.5 | −5 |
| Comparative Example 7 | B-1/B-2 (50/50) | " | " | −12.5 | −5 |
| Example 1 | A-1/B-2 (50/50) | " | " | −10.0 | −10 |
| Example 2 | A-1/B-2 (25/75) | " | " | −12.5 | −13 |
| Example 3 | A-1/B-2 (25/75) | 250 | " | −20.0 | −18 |
| Example 4 | A-2/B-1 (75/25) | 150 | " | −10.0 | −9 |
| Example 5 | A-3/B-2 (25/75) | " | " | −12.5 | −9 |
| Comparative Example 8 | A-1 (single copolymer) | 100 | (2) | −7.5 | −5 |
| Comparative Example 9 | A-2 (single copolymer) | " | " | −7.5 | −4 |
| Comparative Example 10 | B-1 (single copolymer) | " | " | −7.5 | −5 |
| Comparative Example 11 | B-2 (single copolymer) | " | " | −12.5 | −4 |
| Example 6 | A-1/B-2 (25/75) | " | " | −12.5 | −11 |
| Example 7 | A-1/B-2 (25/75) | 200 | " | −15.0 | −16 |

What is claimed is:

1. A middle and/or heavy distillate composition comprising a fuel oil of varying proportions of middle and/or heavy distillate of petroleum and 10–2000 ppm, based on the fuel oil, of a mixture of 1–99% by weight of (A) a copolymer of ethylene with an alkoxyalkyl acrylate or methacrylate represented by the formula,

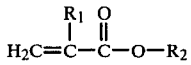

wherein $R_1$ represents hydrogen or $C_1$–$C_2$ alkyl and R is $-C_mH_{2m}-O-C_nH_{2n+1}$, m and n each being an integer of 1–4, and 99–1% by weight of (B) a copolymer of ethylene with a vinyl ester of saturated carboxylic acid and/or an alkyl ester of ethylenic unsaturated carboxylic acid.

2. The middle and/or heavy distillate composition according to claim 1, wherein (A) is the copolymer of ethylene with 2-ethoxyethyl methacrylate and (B) is the copolymer of ethylene with vinyl acetate.

* * * * *

UNITED STATES PATENT AND TRADEMARK OFFICE

CERTIFICATE OF CORRECTION

PATENT NO. : 4,404,000

DATED : September 13, 1983

INVENTOR(S) Yoshiki TOYOSHIMA et al

It is certified that error appears in the above—identified patent and that said Letters Patent is hereby corrected as shown below:

On the title page Insert

--[30] Foreign Application Priority Data

Signed and Sealed this

*Twenty-eighth* Day of *February 1984*

[SEAL]

*Attest:*

GERALD J. MOSSINGHOFF

*Attesting Officer* *Commissioner of Patents and Trademarks*

UNITED STATES PATENT AND TRADEMARK OFFICE

CERTIFICATE OF CORRECTION

PATENT NO. : 4,404,000

DATED : September 13, 1983

INVENTOR(S) : Yoshiki Toyoshima et al

It is certified that error appears in the above-identified patent and that said Letters Patent is hereby corrected as shown below:

On the title page the following should be added:

--(30) Foreign Application Priority Data
Sept. 3, 1981 (JP) Japan 139290/81 --.

This certificate supersedes Certificate of Correction issued February 28, 1984.

Signed and Sealed this

*Twentieth* Day of *November 1984*

[SEAL]

*Attest:*

GERALD J. MOSSINGHOFF

*Attesting Officer*

*Commissioner of Patents and Trademarks*